US005736202A

United States Patent [19]

Chivers

[11] Patent Number: 5,736,202

[45] Date of Patent: Apr. 7, 1998

[54] METHOD FOR PROVIDING MOLTEN BRONZE ON A SUBSTRATE

[75] Inventor: Nigel J. Chivers, Marietta, Ohio

[73] Assignee: Glacier Vandervell, Inc., Troy, Mich.

[21] Appl. No.: 777,533

[22] Filed: Dec. 30, 1996

[51] Int. Cl.[6] ..... H05B 6/02

[52] U.S. Cl. ..... 427/591; 427/431; 427/435; 427/443.2; 427/598

[58] Field of Search ..... 427/591, 431, 427/435, 443.2, 598

[56] References Cited

U.S. PATENT DOCUMENTS

| | | | |
|---|---|---|---|
| 1,370,090 | 3/1921 | Clark | 75/10.14 |
| 2,835,612 | 5/1958 | Taylor | 75/10.11 |
| 4,290,823 | 9/1981 | Dompas | 148/508 |
| 4,389,242 | 6/1983 | Baker et al. | 75/48.1 |

*Primary Examiner*—Bernard Pianalto

*Attorney, Agent, or Firm*—Harness, Dickey & Pierce, P.L.C.

[57] ABSTRACT

The method of providing molten bronze for cladding onto steel strip, wherein the raw material for the product consists of bronze in wire form. The wire is fed at a controlled rate into a cylindrical refractory tube that has induction coils wrapped around the outside. Wire is progressively heated, melted and discharged from the refractory tube through a spout directly onto a moving steel strip to thereby achieve the desired steel/bronze laminate.

5 Claims, 1 Drawing Sheet

1
2
3
10
12
14
16A
16B
16a
17
18
19
20
22
24
28
30
32
34
35
36
37
38

METHOD FOR PROVIDING MOLTEN BRONZE ON A SUBSTRATE

BACKGROUND OF THE INVENTION

This invention relates generally to processes for making sleeve bearings and bushings in which molten bronze is bonded to a steel strip which is subsequently cut into pieces which are then bent to tubular shapes. Traditionally, the raw material for the molten bronze is in the form of shot, ingots, baled wire, etc. The bronze is loaded into an induction furnace where it is melted, brought to temperature, and treated if necessary. The furnace is then tilted to pour the stream of molten bronze through a "bronzing furnace" onto pre-heated moving steel strip. The molten bronze mechanically and chemically bonds to the steel strip while in a process gas atmosphere. The steel/bronze laminate is then cooled to produce a bimetallic strip of the correct bronze microstructure. Several types of bronze alloy can be cast onto a variety of steel strip widths and thicknesses with this conventional process.

The principal object of this invention is provide an improved process to produce the bimetallic bronze/steel strip faster with a smaller utility/labor expenditure, reduced raw material costs and a safer work environment.

SUMMARY OF THE INVENTION

The method of this invention utilizes bronze wire as the raw material. The wire can be provided in various alloys thus providing improved control of the process. The bronze wire is fed into a melting furnace consisting of a cylindrical refractory tube having an axis inclined relative to the horizonal so that it extends downwardly. Induction coils are wrapped around the tube so as to provide three stages of heating zones within the refractory furnace.

The heating is in three zones, namely, a first zone at the inlet end of the refractory tube, followed by a melting zone and terminating in a third zone near the discharge end of the tube. In the first zone, the bronze wire is being moved downwardly toward the discharge end of the furnace, the heat in the first zone being hot enough for a long enough period to heat the wire to a temperature at which is just below its melting temperature. In the second stage, the furnace is hot enough to melt the bronze without changing the basic cylindrical shape of the wire. In the third zone, the electromagnetic forces from the induction coil extending around the refractory tube are increased in magnitude so as to stir the molten bronze in the furnace to obtain complete admixture of the alloying elements that have varying specific gravities. The cylindrical inner shape of the ceramic tube within which the alloy flows is inclined to the horizontal giving the molten bronze flow but not so steep as to lose its cohesion, remaining in a capillary shaft-like shape. Graphite delivery near the inlet of the ceramic tube keeps the bronze alloy free of excessive elemental losses due to carbon having a higher affinity to oxygen than to lead or tin within the bronze alloy.

A second nozzle extends into the ceramic tube at a point just prior to where the bronze becomes molten. In order to prevent melt oxidation, de-oxidizing powder is injected at the second nozzle. The mildly reducing process gas maintains a constant pressure within the refractory tube, there being a gas seal at the inlet to reduce oxygen ingress.

This process avoids the molten metal transfer and the holding of large volumes of molten metal associated with conventional methods. It also eliminates the difficult operation of maintaining a constant rate of bronze pour normally associated with present processes. Also eliminated are the safety hazards of molten metal eruptions and splashes from holding baths. As there is no large area of refractory in contact with the molten metal, gross lining failure within the furnace cannot occur and slag originating from the refractory surface will be minimal.

As the final bronze composition depends solely on the feed material yields approaching 100% are attainable. The slag reduction is in part due to not having to open up a molten bath and consequently expose the surface to oxygen.

Additionally, by constant computer monitoring of temperatures, induction voltage, frequency and kilowatt, there is an automatic control of all three heat zones. The ability to reproduce proven running settings exactly each time a particular job is run throughout the batch run allows precise pouring. Metal loss, a recurring problem with traditional casting due to long distances from hold baths to steel strip is now much reduced by the wire feed melting point being close to the steel strip. Another factor of help is the very small melt surface exposed to oxygen. Also, superheating of the bronze is not required for the same reason. The addition of graphite into the induction furnace assures enough lubricity to the lining of the furnace to maintain a consistent flow of bronze in the furnace toward the discharge end.

Further objects, features and advantages of the invention will become apparent from a consideration of the specification, the appended claims and the drawing in which:

DESCRIPTION OF THE PREFERRED EMBODIMENT

Figures 1, 2, 3:
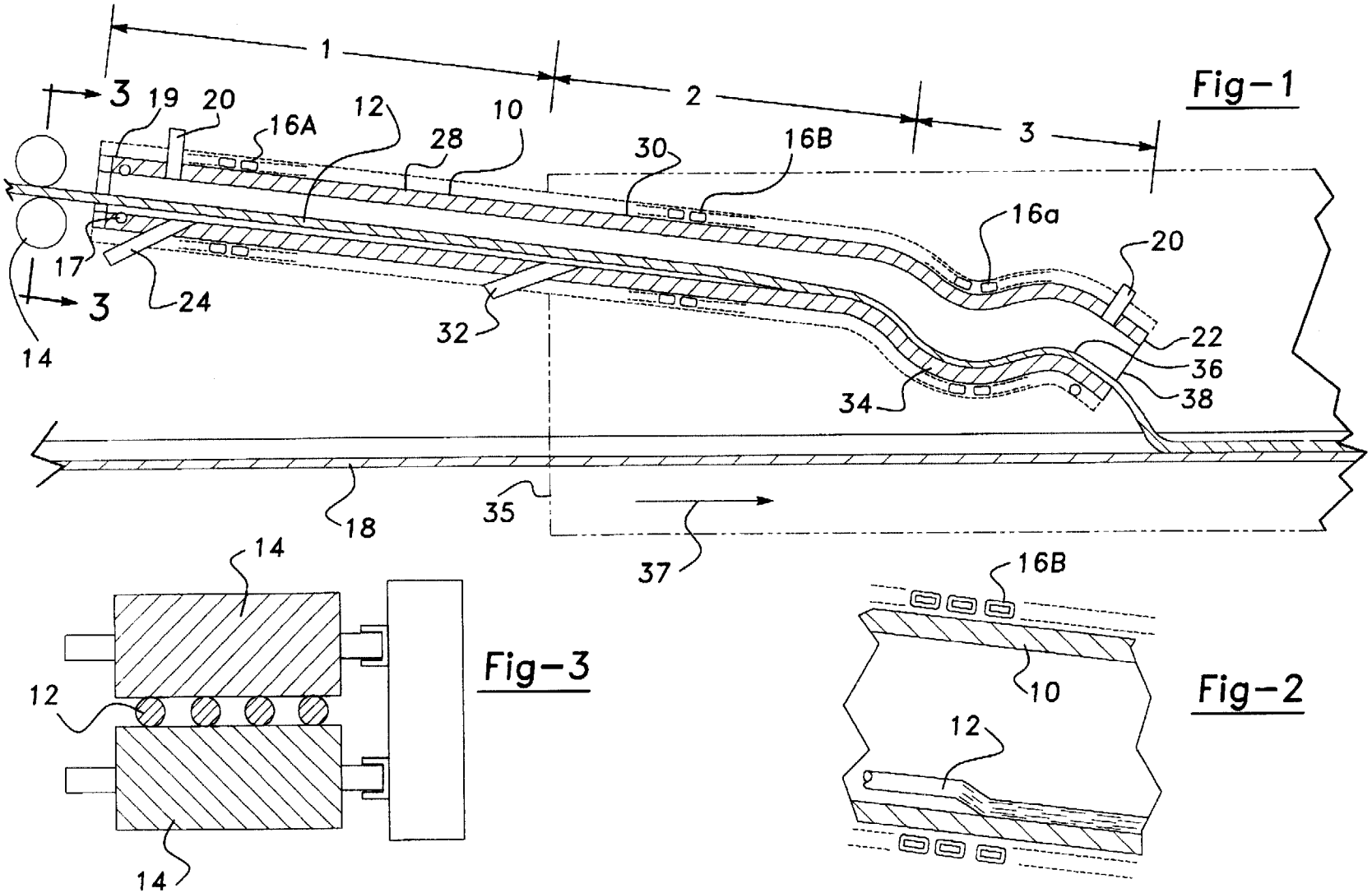
FIG. 1 is a somewhat diagrammatic longitudinal sectional view through the tubular furnace used in the process of this invention and illustrating molten bronze flowing out the discharge end of the furnace onto a steel strip.
FIG. 2 is an enlarged fragmentary view of a portion of the furnace tube shown in FIG. 1.
FIG. 3 is a sectional view of the feed rolls.

With reference to the drawing, the process of this invention is described in connection with a cylindrical refractory tube 10 which forms the melting furnace for bronze wire 12 which is fed into the upper end of the downwardly inclined furnace 10 by feed rolls 14. As shown in FIG. 3, side-by-side feed rolls are shown for feeding more than one wire 12 into the furnace 10. The wires can be fed simultaneously or in tandem depending on whether different alloys are to be used in the wire 12 or if a greater number of wires 12 are needed to maintain a desired production rate.

The furnace tube 10 is encircled by induction coils **16*a*, 16*b*, and 16*c* which create electromagnetic forces in the tube 10 of varying magnitudes to achieve three heating zones shown in FIG. 1 at 1, 2 and 3**.

The induction coils **16*a*, *b* and *c* are wound around the furnace tube 10 for the purposes of heating, melting and stirring the bronze in the wire 12. As shown diagrammatically in FIG. 1, the induction coil 16*a* that is wound around the upper portion 28 of the tube 10, zone 1, provides enough heat to the interior of the furnace tube 10 to heat the bronze wire 12. In an intermediate portion 30 of the tube 10, the induction coil 16*b* provides enough to the interior of the furnace portion 30 to melt the bronze wire 12. The heat in the intermediate section of the tube 30 creates a zone 2** condition in which the bronze alloy in wire 12 flows freely downwardly by virtue of the tilt of the furnace section 30 to the horizontal, without causing the bronze to lose its cohesion. As a result, the wire 12 which is now in a molten state remains in a capillary shaft-like shape. Each of the three stages, 1,2 and 3 have their own thermocouples, not shown, which operate in a well known manner to control the induction coil activity in order to achieve the desired results.

The wire 12, which is now in a molten state, flows under gravity through the tube section 30 to a lower end section 34 of the tube 10 which has a downwardly concave shape to create a partial weir 36. The induction coil 16*c*, zone 3, is structured so that it has a frequency adequate to provide for stirring of the alloy 12 in the curved portion 34 of the furnace immediately behind the weir 36. The stirring by the electromagnetic forces from the induction coil 16*c* in stage 3 is essential at this stage to obtain complete ad-mixture of the alloying elements that have varying specific gravities. Just prior to the weir 36, the alloy masses to ensure the correct mixture and temperature; beyond the weir, the bronze continues under gravity via a heated spout 38 onto a preheated steel strip 18. The pre-heated steel strip 18 is positioned in a "bronzing chamber" 35 and is continuously moving in the direction of the arrow 37. The molten bronze from the wire 12 mechanically and chemically bonds to the steel strip 18 which is moving in a direction of the arrow shown in FIG. 1. The result is a laminate of steel and bronze.

A gas seal 17 is provided at the upper end 19 of the furnace 10 and inlet tubes 20 are provided near the ends 19 and 22 of the refractory tube 10. Process gas is supplied continuously to the inlet pipes 20 to maintain a constant pressure within the furnace tube 10, with the seal 18 at the upper end reducing the ingress of oxygen.

A nozzle 24 is positioned in a side wall of the tubular furnace 10 so that graphite can be added into the interior of the furnace tube 10 during the heating and melting of the bronze rod 12. The graphite will keep the bronze alloy free of excessive elemental losses due to carbon having a higher affinity to oxygen than led or tin within the bronze alloy. The graphite also serves to provide some lubricity to the interior surface of the refractory tube 10 to assist in maintaining a consistent alloy flow.

In order to prevent tin losses in the bronze alloy in the furnace tube 10, further de-oxidizing powder is injected into the furnace atmosphere through a nozzle 32 located at the beginning of the intermediate section 30 of the furnace tube 10. In other words, in the beginning of stage 2 is where the de-oxidizing powder is delivered into the interior of the tube 10.

The present process avoids mass holding and molten metal transfer associated with conventional methods. It also eliminates the difficult operation of maintaining a constant rate of bronze pour normally associated with hydraulically tilted furnaces. Also eliminated are the safety hazards of furnace molten metal eruptions and splashes from holding baths. As there is no large area of refractory in contact with the molten metal, gross lining failure cannot occur, and slag originating from the refractory surface will be minimal. As the final bronze composition depends almost solely on the feed material, yields approaching 100% are attainable.

The ability to reproduce proven running settings exactly each time a particular job is run through the batch run allows precise pouring. Metal loss, a recurring problem with traditional casting due to long distances from hold bath to steel strip is now much reduced by the wire feed meeting point being close to the steel strip. Another factor of help is very small melt surface exposed to oxygen. Also, superheating of the bronze is not required for the same reason.

From the above description, it is seen that this invention provides an improved method for providing molten bronze in the manufacture of bimetallic strip.

It is to be understood that the invention is not limited to the exact construction illustrated and described above, but that various changes and modifications may be made without departing from the spirit and scope of the invention as defined in the following claims.

I claim:

1. The method of providing molten bronze for cladding onto steel strip, said method comprising the steps off a) providing a melting furnace consisting of a cylindrical refractory tube having an axis inclined relative to the horizontal so that it extends downwardly; creating electromagnetic forces in said tube to heat the tube;

b) feeding bronze wire into said refractory tube for movement axially downwardly in the tube;

c) controlling said electromagnetic forces so as to first heat the moving wire in the furnace and then melt the wire so that it will flow out of the tube onto a pre-heated steel strip.

2. The method of claim 1 wherein said wire is of a substantially round section.

3. The method of providing molten bronze for cladding onto steel strip, said method comprising the steps of:

a) providing a melting furnace consisting of a cylindrical refractory tube having an axis inclined relative to the horizontal so that it extends downwardly so that the refractory tube has an upper end and a lower end;

b) creating electro-magnetic forces in said tube so as to provide a first heating zone in said refractory tube adjacent said upper end, a second melting zone between said upper and lower ends and a third zone at the lower end of the refractory tube where a desired temperature is maintained and electro-magnetic forces of a greater magnitude are generated;

c) feeding bronze wire into said refractory tube for movement axially downwardly in the tube so as to subject said bronze wire progressively to said first, second and third zones in said refractory tube to thereby first heat the wire, then melt the wire and finally stir the bronze in the wire;

d) said electro-magnetic forces in said third zone being created at a frequency to provide stirring of the molten bronze in the tube as the bronze approaches the lower discharge end of the refractory tube;

e) maintaining a constant gas pressure within the refractory tube to reduce oxygen entering the refractory tube; and f) allowing the molten bronze to flow out of the tube onto a preheated steel strip.

4. The process according to claim 3 including the step of adding de-oxidizing powder into the refractory tube at a point near the beginning of the second zone in order to prevent melt losses.

5. The process according to claim 3 further including the step of delivering graphite into the refractory robe in the first zone to keep the bronze alloy free of excessive elemental losses due to carbon having a higher affinity to oxygen than other elements within the bronze alloy.

* * * * *